US010697229B2

(12) United States Patent
Hauville et al.

(10) Patent No.: US 10,697,229 B2
(45) Date of Patent: Jun. 30, 2020

(54) DUCTLESS OR DUCTED FUMEHOOD WITH IMPROVED FRONT SASH CLOSURE

(71) Applicants: FIPAK Research And Development Company, Rowley, MA (US); Marie Hauville, Ipwich, MA (US)

(72) Inventors: Francois Hauville, Ipswich, MA (US); Stephan Hauville, Rowley, MA (US); Antoine Hauville, Val de Reuil (FR); Cédric Herry, Val de Reuil (FR)

(73) Assignee: FIPAK Research And Development Company, Rowley, MA (US)

( * ) Notice: Subject to any disclaimer, the term of this patent is extended or adjusted under 35 U.S.C. 154(b) by 797 days.

(21) Appl. No.: 14/465,613

(22) Filed: Aug. 21, 2014

(65) Prior Publication Data

US 2015/0056904 A1 Feb. 26, 2015

Related U.S. Application Data

(60) Provisional application No. 61/868,660, filed on Aug. 22, 2013.

(51) Int. Cl.

| | |
|---|---|
| ***E06B 3/50*** | (2006.01) |
| ***B08B 15/02*** | (2006.01) |
| ***B25H 1/20*** | (2006.01) |
| ***B01L 1/00*** | (2006.01) |

(52) U.S. Cl.

CPC ..... *E06B 3/50* (2013.01); *B01L 1/00* (2013.01); *B08B 15/023* (2013.01); *B25H 1/20* (2013.01); *B01L 2200/141* (2013.01); *B01L 2300/043* (2013.01)

(58) Field of Classification Search

CPC . E06B 3/50; B01L 1/00; B08B 15/023; B25H 1/20

USPC ..... 454/56, 59

See application file for complete search history.

(56) References Cited

U.S. PATENT DOCUMENTS

| | | | | |
|---|---|---|---|---|
| 2,797,840 | A * | 7/1957 | Gibbs | E05D 7/1077 16/262 |
| 3,041,957 | A | 7/1962 | Liptay | |
| 3,726,206 | A | 4/1973 | Worick, Jr. | |
| 3,897,721 | A | 8/1975 | Fuhst | |
| 3,941,040 | A | 3/1976 | Carlson | |

(Continued)

FOREIGN PATENT DOCUMENTS

| | | |
|---|---|---|
| CN | 201394566 | 2/2010 |
| CN | 201887350 | 6/2011 |

(Continued)

*Primary Examiner* — Edelmira Bosques
*Assistant Examiner* — Dana K Tighe
(74) *Attorney, Agent, or Firm* — Pandiscio & Pandiscio

(57) ABSTRACT

A novel front sash closure for a fumehood of the sort comprising a workspace defined by a frame and accessed by a front opening, the front sash closure comprising:

a transparent fixed pane and a transparent hinged pane;

wherein the transparent fixed pane is securely mounted to the frame of the fumehood so as to partially cover the front opening of the fumehood, whereby to reduce the size of the front opening of the fumehood to a working opening; and wherein the transparent hinged pane is hingedly mounted to the frame of the fumehood intermediate the working opening so as to be able to selectively cover a portion of the working opening.

18 Claims, 18 Drawing Sheets

(56) References Cited

U.S. PATENT DOCUMENTS

| | | | | | |
|---|---|---|---|---|---|
| 4,666,478 | A * | 5/1987 | Boissinot | A61L 9/16 | 126/299 D |
| 5,056,422 | A * | 10/1991 | Horntvedt | B08B 15/023 | 454/57 |
| 5,360,371 | A * | 11/1994 | Bartimote | B08B 15/026 | 454/56 |
| 5,997,397 | A * | 12/1999 | Frickel | B08B 15/023 | 312/209 |
| 2008/0311837 | A1* | 12/2008 | Hsu | B08B 15/023 | 454/65 |
| 2009/0211451 | A1* | 8/2009 | Hauville | B08B 15/023 | 95/286 |
| 2011/0036145 | A1 | 2/2011 | Dobbyn | | |
| 2012/0052783 | A1 | 3/2012 | Reynolds | | |

FOREIGN PATENT DOCUMENTS

| | | |
|---|---|---|
| DE | 2116601 | 9/1983 |
| DE | 3224530 | 1/1984 |
| FR | 2334432 | 7/1977 |
| FR | 2922469 | 8/2010 |
| JP | 58-28148 | 6/1983 |
| KR | 10-1112024 | 11/2010 |
| WO | WO 95/12465 | 5/1995 |

* cited by examiner

DUCTLESS OR DUCTED FUMEHOOD WITH IMPROVED FRONT SASH CLOSURE

REFERENCE TO PENDING PRIOR PATENT APPLICATION

This patent application claims benefit of U.S. Provisional Patent Application Ser. No. 61/868,660, filed Aug. 22, 2013 by FIPAK Research And Development Company and Francois Hauville et al. for DUCTLESS OR DUCTED FUMEHOOD WITH IMPROVED FRONT SASH CLOSURE, which patent application is hereby incorporated herein by reference.

FIELD OF THE INVENTION

This invention relates to air filtration systems in general, and more particularly to fumehoods for providing an enclosed workspace which is isolated (or substantially isolated) from the ambient air in order to allow dangerous substances to be safely handled in the enclosed workspace without endangering nearby personnel. In one particularly preferred form, the invention relates to ductless fumehoods which are configured to purge hazardous substances from the air of the enclosed workspace before venting that air to the ambient air of the room containing the ductless fumehood.

BACKGROUND OF THE INVENTION

Air filtration systems are used in many situations to purge unwanted substances from the air. Such air filtration systems generally exist in a variety of forms, depending upon their use and function.

One type of air filtration system is the fumehood. Fumehoods provide an enclosed workspace which is isolated (or substantially isolated) from the ambient air in order to allow dangerous substances to be safely handled in the enclosed workspace without endangering nearby personnel. Fumehoods are generally either ducted or ductless. Ducted fumehoods are configured to purge hazardous substances from the air of the enclosed workspace before venting that air to the ambient atmosphere. Ductless fumehoods are configured to purge hazardous substances from the air of the enclosed workspace before venting that air to the ambient air of the room containing the ductless fumehood.

The present invention is applicable to both ducted and ductless fumehoods. In one preferred form, the present invention relates to ductless fumehoods. To this end, and for purposes of illustration but not limitation, the present invention will now be discussed in the context of ductless fumehoods.

More particularly, and looking now at FIGS. 1 and 2, there is shown a typical prior art ductless fumehood 5. Ductless fumehood 5 generally comprises an enclosed workspace 10 defined by a frame 12 and accessed by a front sash closure 15, with front sash closure 15 engaging a workbase 20 when the enclosed workspace is "sealed". An air inlet 25 admits ambient air into enclosed workspace 10, and an air vent 30 removes air from enclosed workspace 10. Air from air vent 30 is passed through a filter 35 before being returned to the ambient air of the room (e.g., a laboratory) containing ductless fumehood 5 via an air outlet 37. Filter 35 removes hazardous substances from the air, thereby rendering the air safe before it is returned to the ambient air. An outlet fan 40 is generally provided between air vent 30 and air outlet 37 so as to keep enclosed workspace 10 at a negative pressure differential relative to the ambient air, whereby to ensure that any air within enclosed workspace 10 passes through filter 35 before being returned to the ambient air. A sensor 45 is generally provided at (or downstream of) filter 35 so as to ensure that the filter purges any hazardous substances from the workspace air before that air is returned to the ambient air. Outlet fan 40 and sensor 45 are generally connected to an alarm 50 which can alert personnel in the event that filter 35, outlet fan 40 and/or sensor 45 fail.

Ductless fumehoods have become popular due to their technical effectiveness, low acquisition and implementation costs, rapid installation and substantial energy savings. More particularly, with proper filter selection, ductless fumehoods can be extremely effective in removing hazardous substances from the air of a workspace. Furthermore, due to their simple design and their ductless nature, ductless fumehoods are relatively inexpensive to manufacture and relatively inexpensive to implement, since they do not require the extensive engineering and installation efforts normally associated with ducted fumehoods. Furthermore, installation of ductless fumehoods is fast and simple, since ductless fumehoods require little more than uncrating and initial setup and testing before use. Ductless fumehoods are also extremely energy efficient, since they return the filtered air to the ambient air of the room rather than venting the filtered air to the outside atmosphere. As a result, already-heated air is retained in the room during winter and already-cooled air is retained in the room during summer, thereby minimizing the energy required to temperature-condition the air in the room.

With ductless fumehoods, it is important to manage the airflow out of enclosed workspace 10 in order to ensure that all hazardous substances are removed from the workspace air before it is allowed to return to the ambient air of the room. Ideally, this means that all of the enclosed workspace air is passed through filter 35 before that air is allowed to return to the ambient air of the room. In practice, however, this is difficult to ensure, inasmuch as personnel must typically repeatedly and actively access enclosed workspace 10 through front sash closure 15, and hence some air from the enclosed workspace may pass into the air of the room via the open front sash closure 15 without first passing through filter 35. To limit this occurrence, and as previously discussed, outlet fan 40 is set to keep enclosed workspace 10 at a negative pressure differential relative to the ambient air, whereby to minimize unintentional airflow out open front sash closure 15. In addition, front sash closure 15 is typically arranged so as to minimize the size of the opening provided into enclosed workspace 10.

More particularly, and looking now at FIGS. 3 and 4, front sash closure 15 typically comprises a plurality of interconnected sliding panes 55. When enclosed workspace 10 is to be accessed by personnel, the bottommost pane 55 is lifted upwards, causing the interconnected sliding panes 55 to overlap in a cascading fashion whereby to progressively expose more and more of the enclosed workspace to the personnel. Thus, a conventional front sash closure 15 provides a variable-sized opening into enclosed workspace 10, with the variable-sized opening enlarging upward "from the bottom up".

While conventional front sash closures 15 of the sort shown in FIGS. 1-4 have proven highly effective and highly reliable, they can also provide a sub-optimal solution in certain situations. More particularly, as noted above, conventional front sash closures 15 open "from the bottom up". Thus, in situations where the objects to be manipulated (e.g., test tubes, beakers, etc.) sit directly on workbase 20 and are relatively short, the "bottom up" closure of conventional front sash closure 15 need only expose a relatively small region of enclosed workspace 10 in order to provide the personnel with appropriate access to the objects which are to be manipulated. However, in situations where the objects to be manipulated sit elevated above workbase 20 (e.g., on a stand or pole) and/or are relatively tall, the "bottom up" closure of conventional front sash closure 15 requires that a relatively large region of enclosed workspace 10 be exposed in order to provide the personnel with appropriate access to the objects which are to be manipulated. However, it will be appreciated that this is a sub-optimal solution, since it increases the possibility that hazardous substances may escape from enclosed workspace 10 through the open front sash closure 15.

It will be appreciated that the same issue can arise with respect to ducted fumehoods which use a conventional front sash closure 15 comprising the aforementioned cascading sliding panes 55.

Thus there is a need for an improved front sash closure for a ductless fumehood, and/or a ducted fumehood, which addresses the foregoing issues.

SUMMARY OF THE INVENTION

The present invention comprises the provision and use of an improved front sash closure for a ductless fumehood, and/or a ducted fumehood, which addresses the foregoing issues.

More particularly, in accordance with the present invention, an improved front sash closure is provided which comprises a transparent fixed pane and a transparent hinged pane. The transparent fixed pane is securely mounted to the frame of the ductless fumehood so as to partially cover the front opening of the ductless fumehood, whereby to reduce the size of the front opening to a smaller working opening. The transparent hinged pane is hingedly mounted to the frame of the ductless fumehood intermediate the working opening so as to selectively cover a portion of the working opening, i.e., so that the transparent hinged pane is selectively able to cover either (i) a top portion of the working opening or (ii) a bottom portion of the working opening. As a result of the foregoing, in situations where the objects to be manipulated sit directly on the workbase of the ductless fumehood and are relatively short, the transparent hinged pane is set in its "up" position whereby to provide personnel with appropriate access to the objects which are to be manipulated. However, in situations where the objects to be manipulated sit elevated above the workbase of the ductless fumehood, the hinged pane is set in its "down" position so as to provide personnel with appropriate access to the objects which are to be manipulated.

In one preferred form of the present invention, there is provided a front sash closure for a fumehood of the sort comprising a workspace defined by a frame and accessed by a front opening, said front sash closure comprising:

a transparent fixed pane and a transparent hinged pane;

wherein said transparent fixed pane is securely mounted to the frame of the fumehood so as to partially cover the front opening of the fumehood, whereby to reduce the size of the front opening of the fumehood to a working opening; and wherein said transparent hinged pane is hingedly mounted to the frame of the fumehood intermediate the working opening so as to be able to selectively cover a portion of the working opening.

In another preferred form of the present invention, there is provided a fumehood, the fumehood comprising:

a workspace defined by a frame and accessed by a front opening; and a front sash closure mounted to said frame, said front sash closure comprising:

a transparent fixed pane and a transparent hinged pane;

wherein said transparent fixed pane is securely mounted to said frame of said fumehood so as to partially cover said front opening of said fumehood, whereby to reduce the size of said front opening of said fumehood to a working opening; and wherein said transparent hinged pane is hingedly mounted to said frame of said fumehood intermediate said working opening so as to be able to selectively cover a portion of said working opening.

In another preferred form of the present invention, there is provided a method for handling hazardous substances, said method comprising:

providing a fumehood, said fumehood comprising:

a workspace defined by a frame and accessed by a front opening; and a front sash closure mounted to said frame, said front sash closure comprising:

a transparent fixed pane and a transparent hinged pane;

wherein said transparent fixed pane is securely mounted to said frame of said fumehood so as to partially cover said front opening of said fumehood, whereby to reduce the size of said front opening of said fumehood to a working opening; and wherein said transparent hinged pane is hingedly mounted to said frame of said fumehood intermediate said working opening so as to be able to selectively cover a portion of said working opening; and positioning the hazardous substances within said workspace of said fumehood.

BRIEF DESCRIPTION OF THE DRAWINGS

These and other objects and features of the present invention will be more fully disclosed or rendered obvious by the following detailed description of the preferred embodiments of the invention, which are to be considered together with the accompanying drawings wherein like numbers refer to like parts and further wherein.

DETAILED DESCRIPTION OF THE PREFERRED EMBODIMENTS

Figure 1:
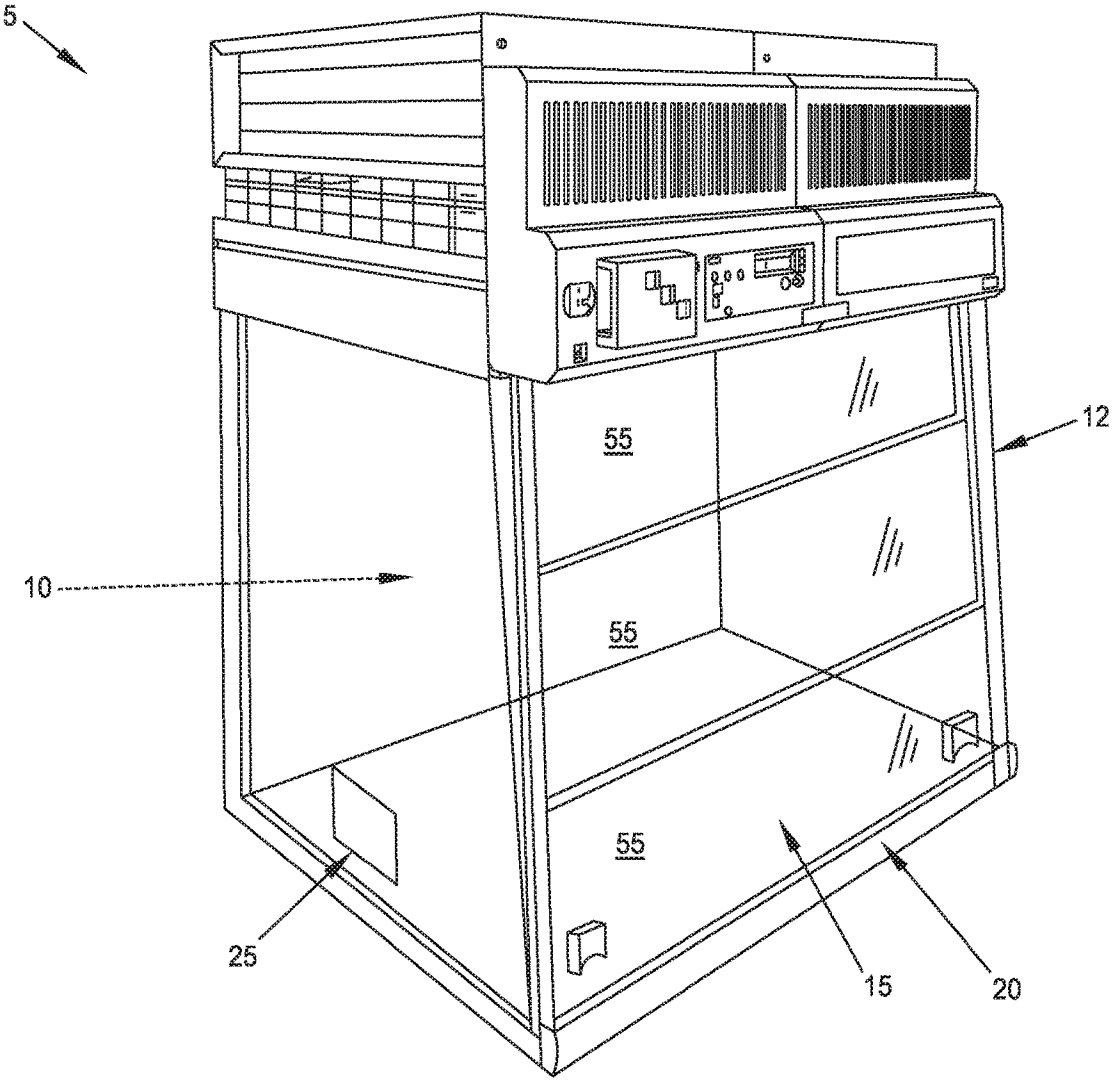
FIG. 1 (PRIOR ART)
FIGS. 1-4 are schematic views showing a prior art ductless fumehood.
Figure 2:
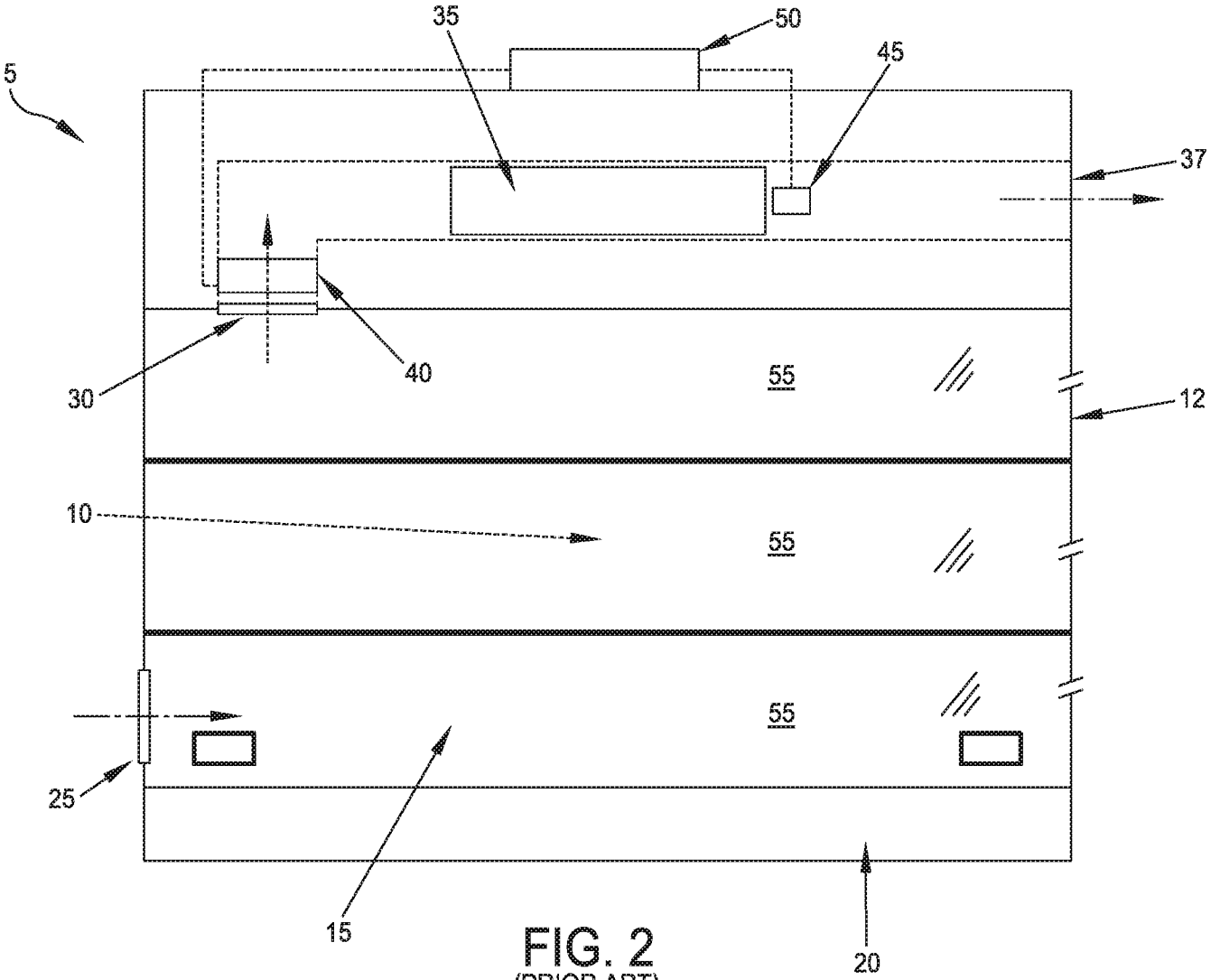
FIG. 2 (PRIOR ART)
Figure 4:
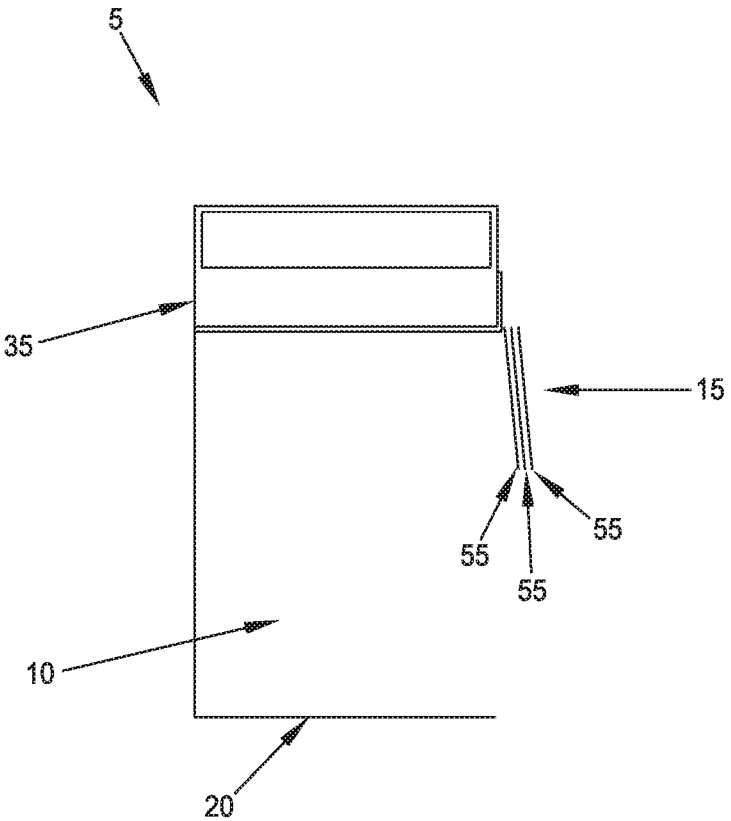
FIG. 4 (PRIOR ART)
Figure 3:
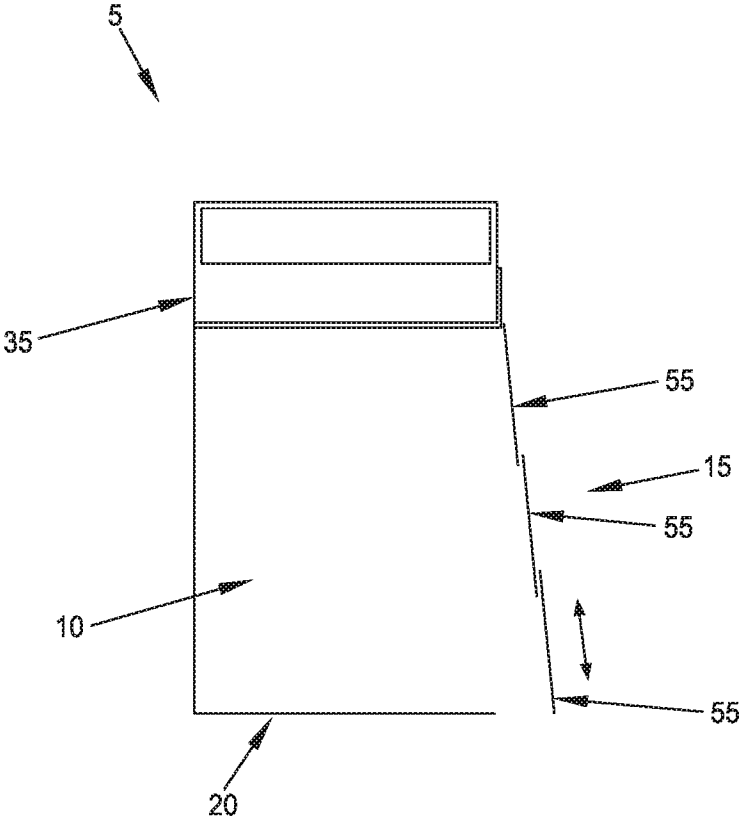
FIG. 3 (PRIOR ART)

The present invention comprises the provision and use of an improved front sash closure for a ductless fumehood, and/or a ducted fumehood, which addresses the foregoing issues.

More particularly, and looking now at FIGS. 5-10, in one preferred form of the present invention, there is provided a ductless fumehood 5 having a novel front sash closure 100. Novel front sash closure 100 comprises a transparent fixed pane 105 and a transparent hinged pane 110.

Transparent fixed pane 105 is securely mounted to frame 12 of ductless fumehood 5 so as to partially cover the front opening 115 of the ductless fumehood. By way of example but not limitation, transparent fixed pane 105 may be sized so as to cover approximately 25% of the area of front opening 115, whereby to reduce the size of front opening 115 to a working opening 120. In one preferred form of the invention, transparent fixed pane 105 is disposed at the upper end of front opening 115, so that working opening 120 is disposed at the bottom end of front opening 115 (i.e., adjacent to workbase 20, in the manner shown in FIGS. 5-10).

Figure 6:
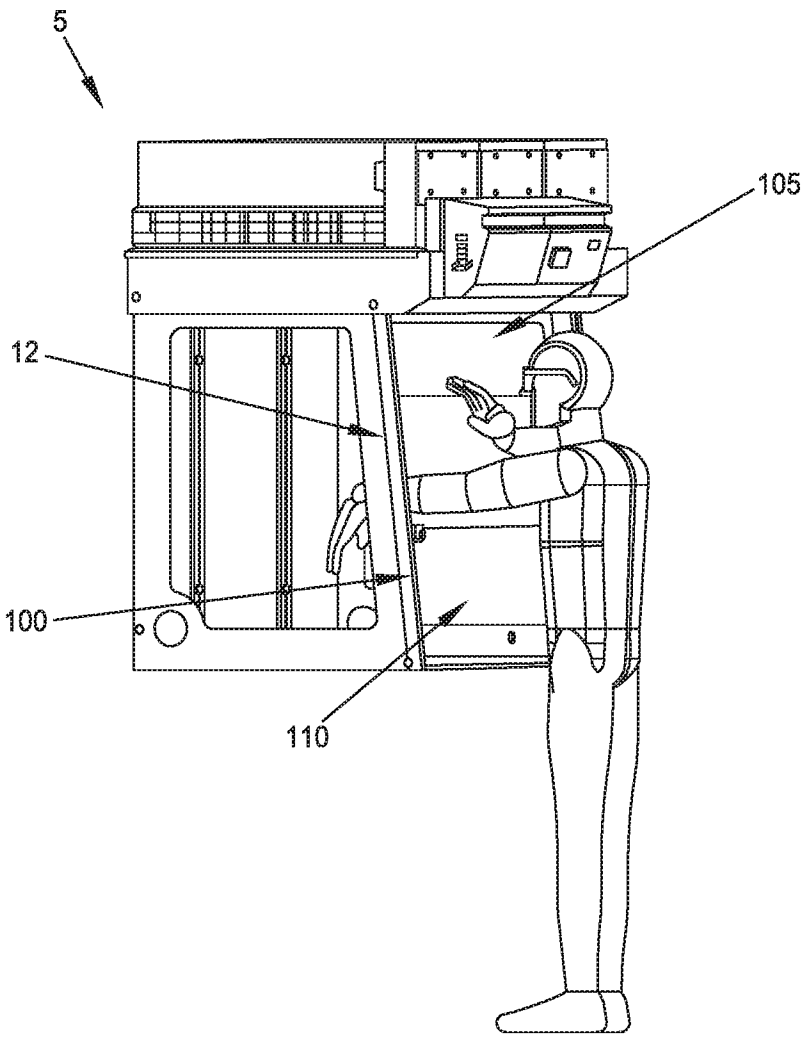
FIGS. 5-10 are schematic views showing a novel ductless fumehood formed in accordance with the present invention.

Transparent hinged pane 110 is hingedly mounted to the frame of ductless fumehood 5 intermediate working opening 120 so as to be able to selectively cover a portion of working opening 120. More particularly, in one preferred form of the invention, transparent hinged pane 110 is sized so as to have an area which is 50% of the area of working opening 120, and is hingedly mounted to the frame 12 of ductless fumehood 5 midpoint in working opening 120, so that transparent hinged pane 110 is selectively able to cover either (i) the top half of working opening 120 (FIG. 5) or (ii) the bottom half of working opening 120 (FIG. 6).

In one preferred form of the invention, two hinges 125 are used to hingedly mount transparent hinged pane 110 to frame 12 of ductless fumehood 5. In addition, two latches 130 are provided to allow transparent hinged pane 110 to be locked in its "up" position (i.e., so that transparent hinged pane 110 covers the upper half of working opening 120, in the manner shown in FIG. 5) or in its "down" position (i.e., so that transparent hinged pane 110 covers the lower half of working opening 120, in the manner shown in FIG. 6).

Figure 5:
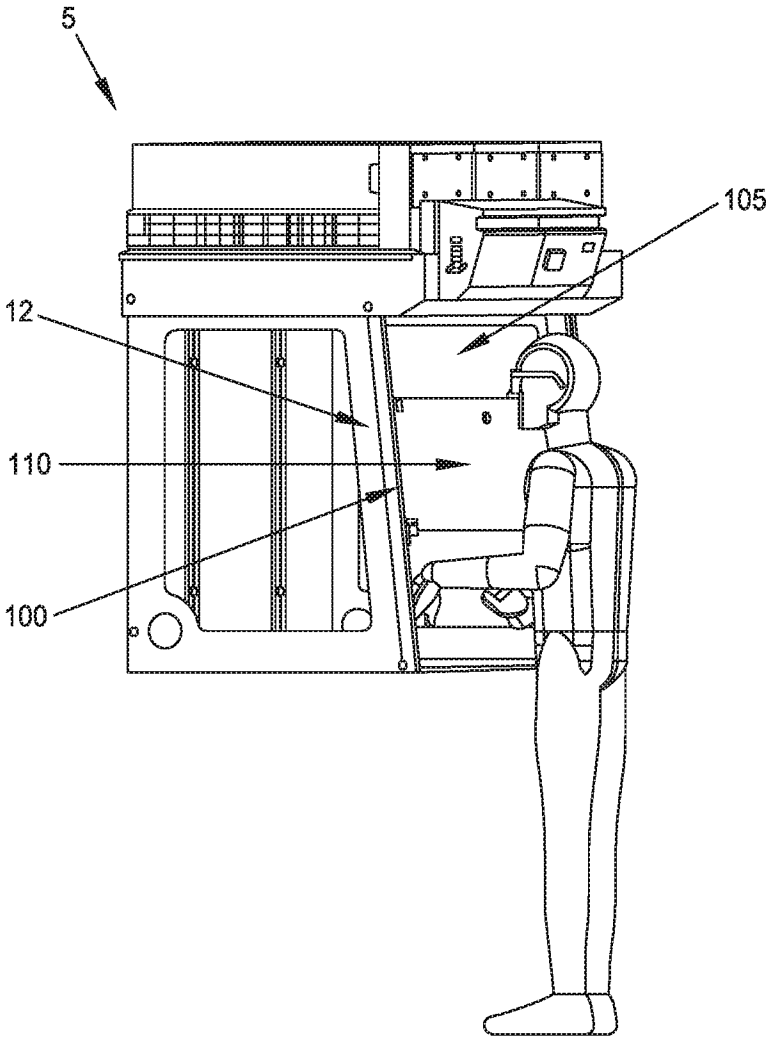
Figure 8:
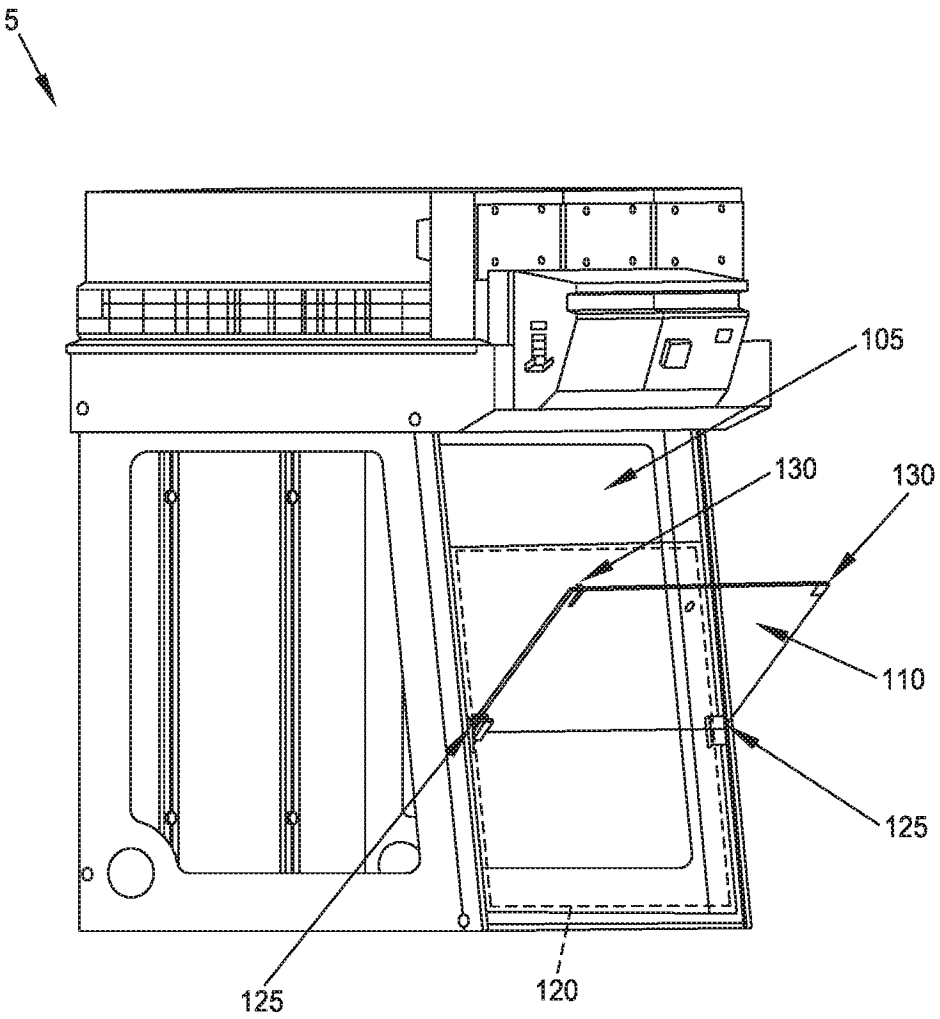
Figure 7:
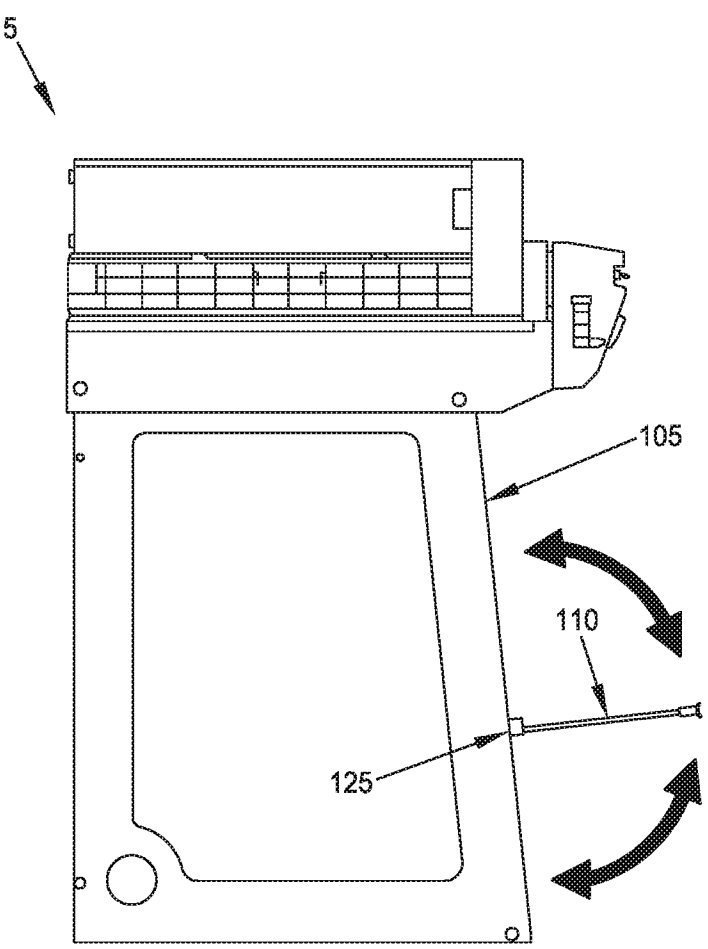
Figure 10:
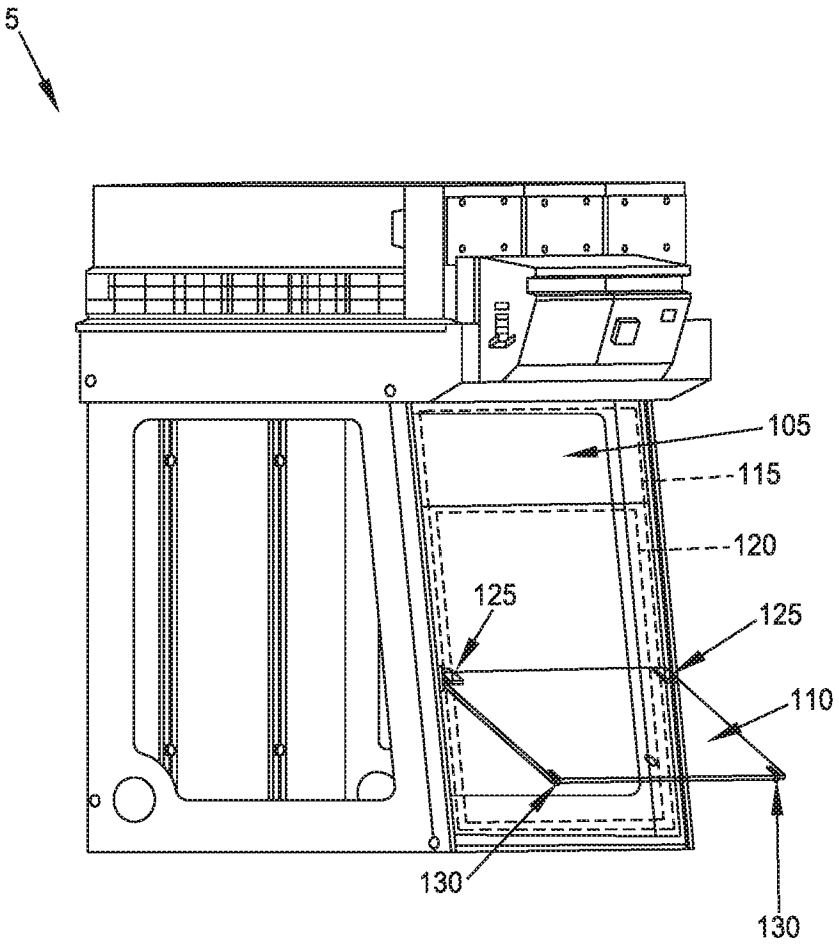
Figure 9:
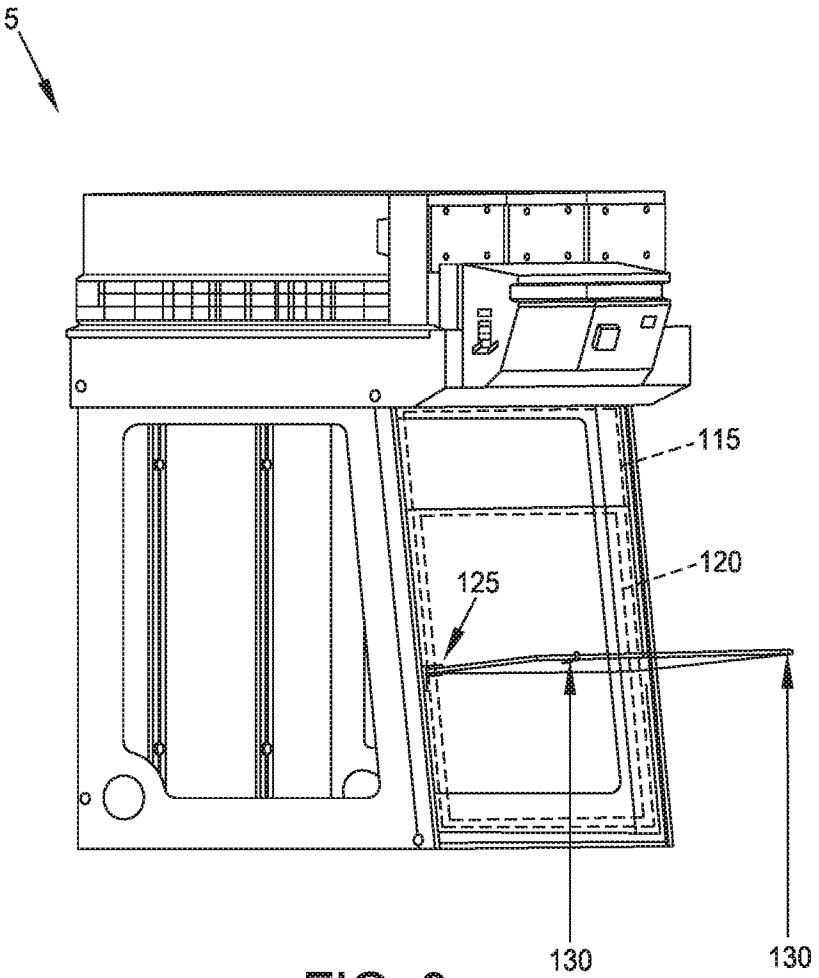
Figure 11:
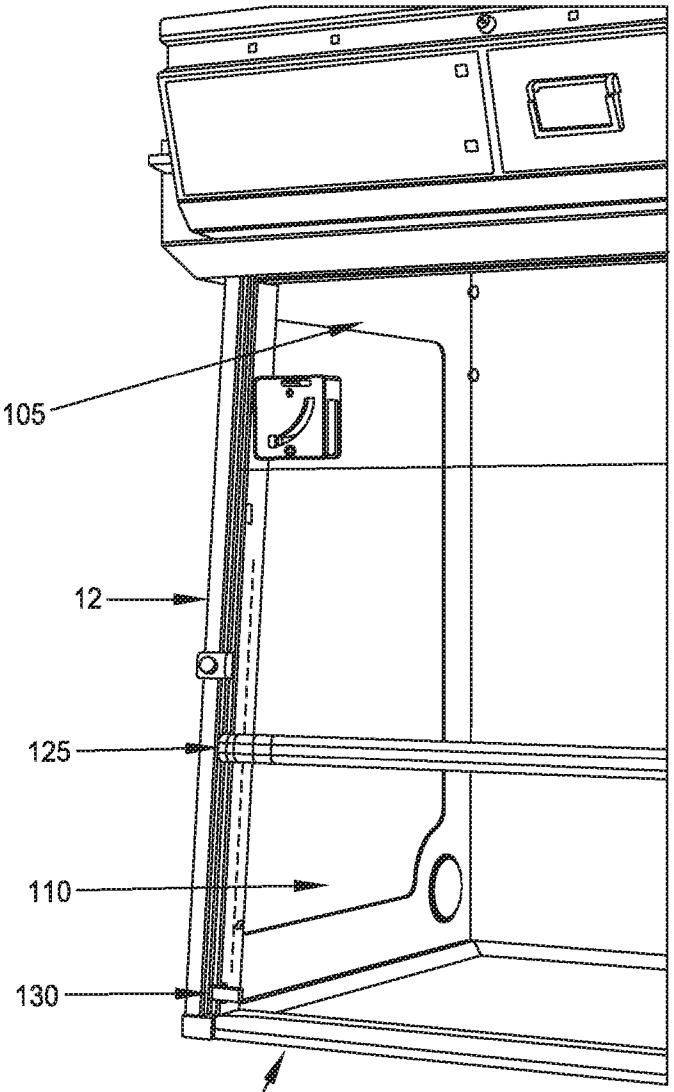
FIGS. 11-16 are schematic views showing various construction details of the novel ductless fumehood shown in FIGS. 5-10.
Figure 12:
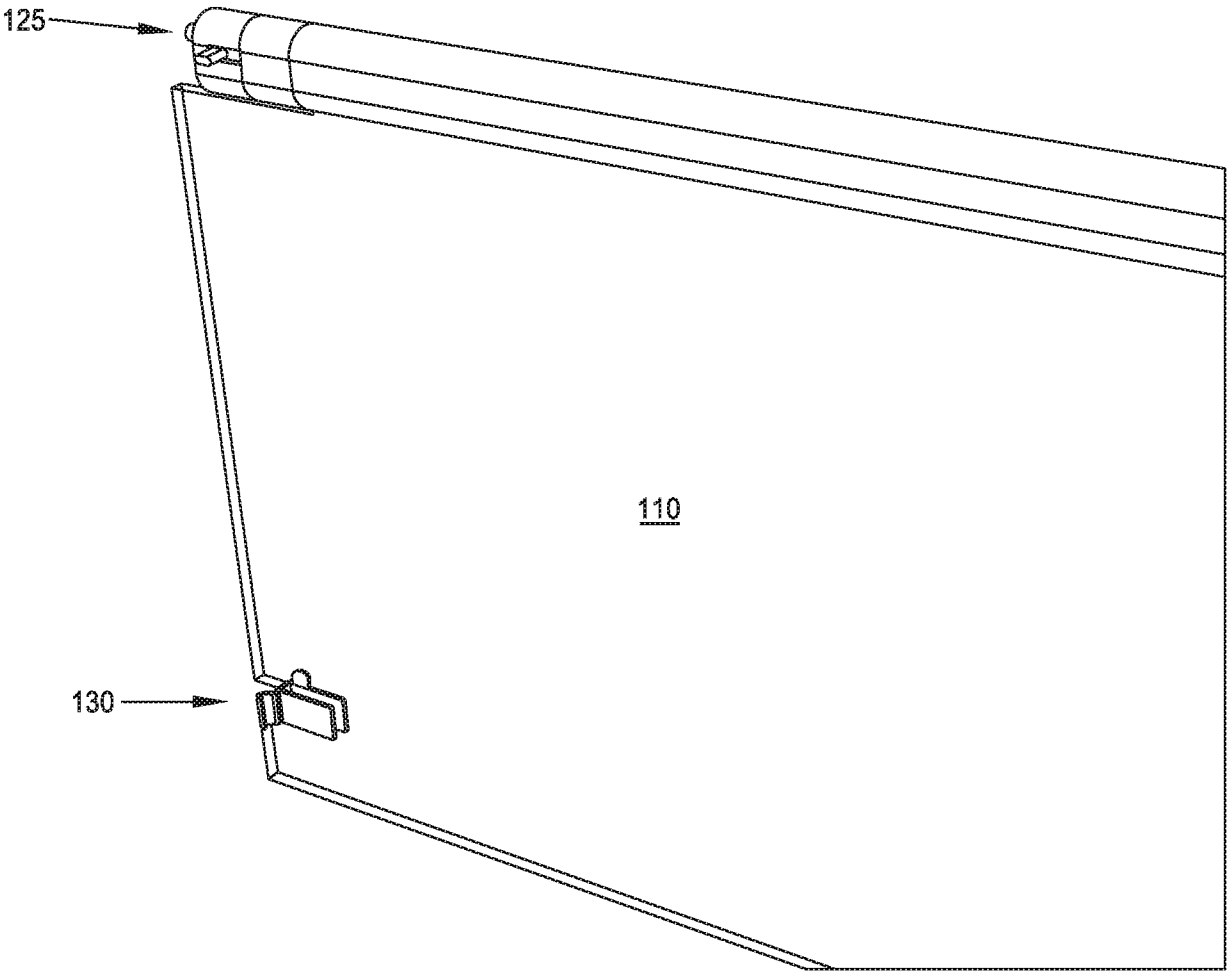
Figure 13:
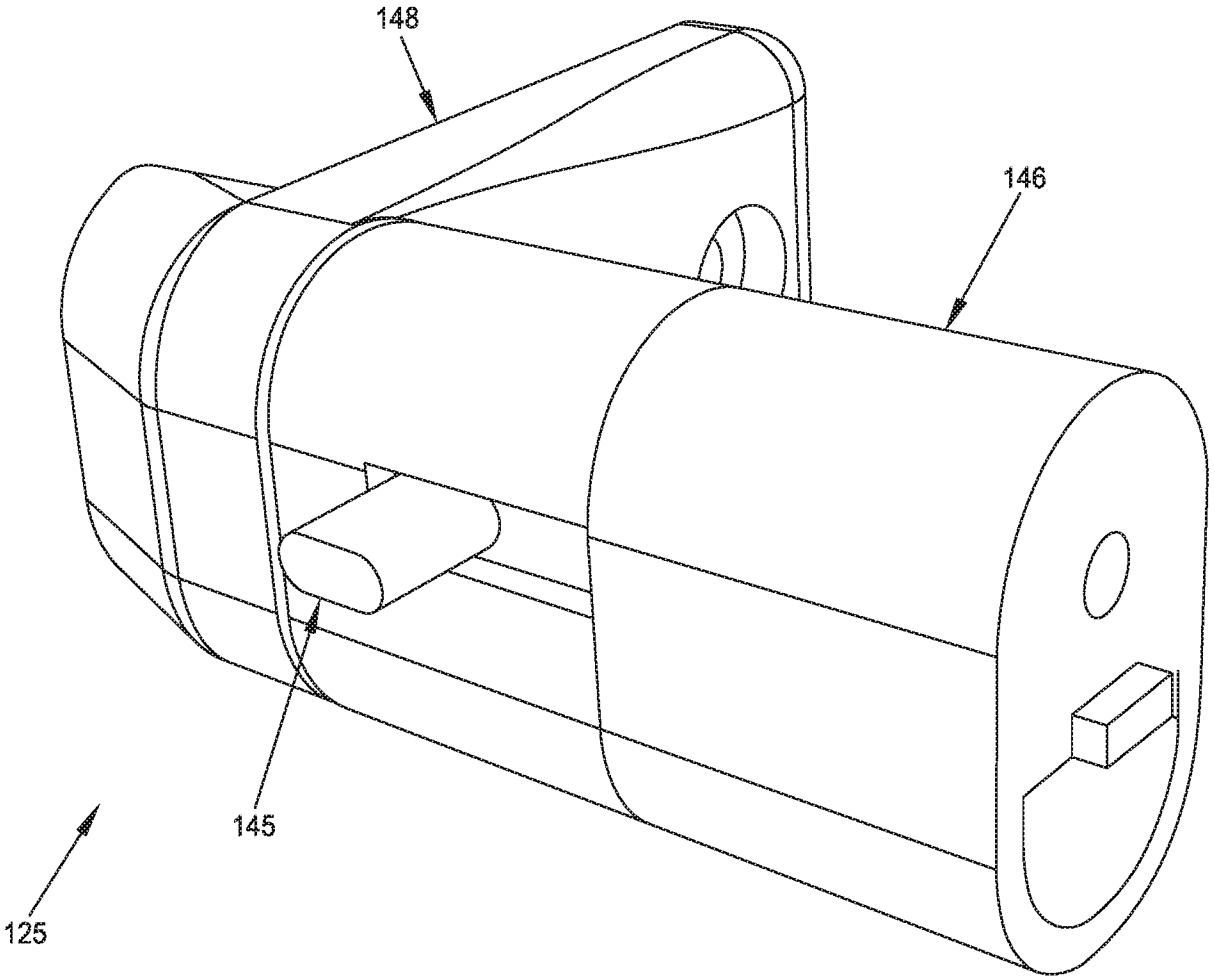
Figure 14:
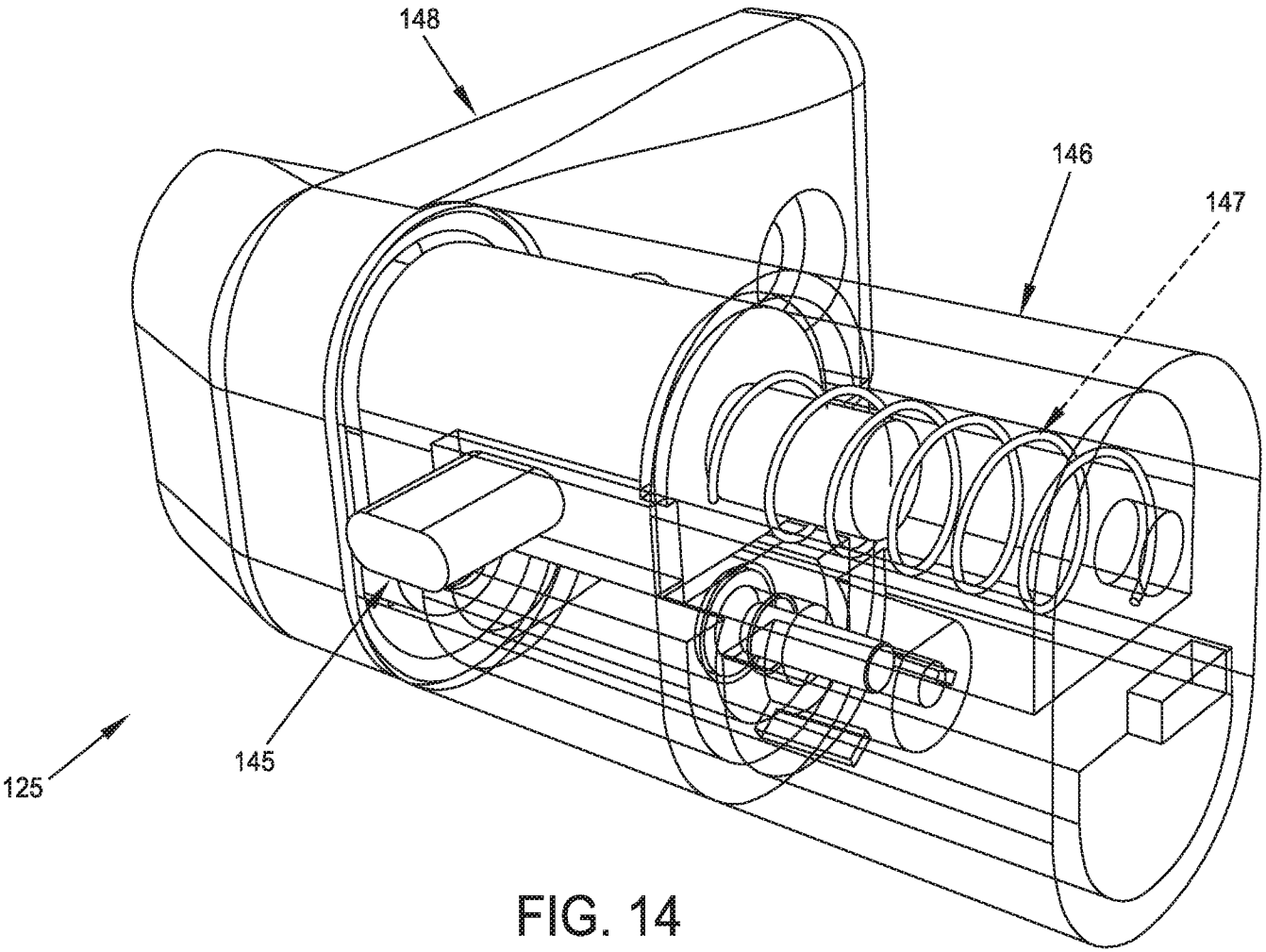
Figure 15:
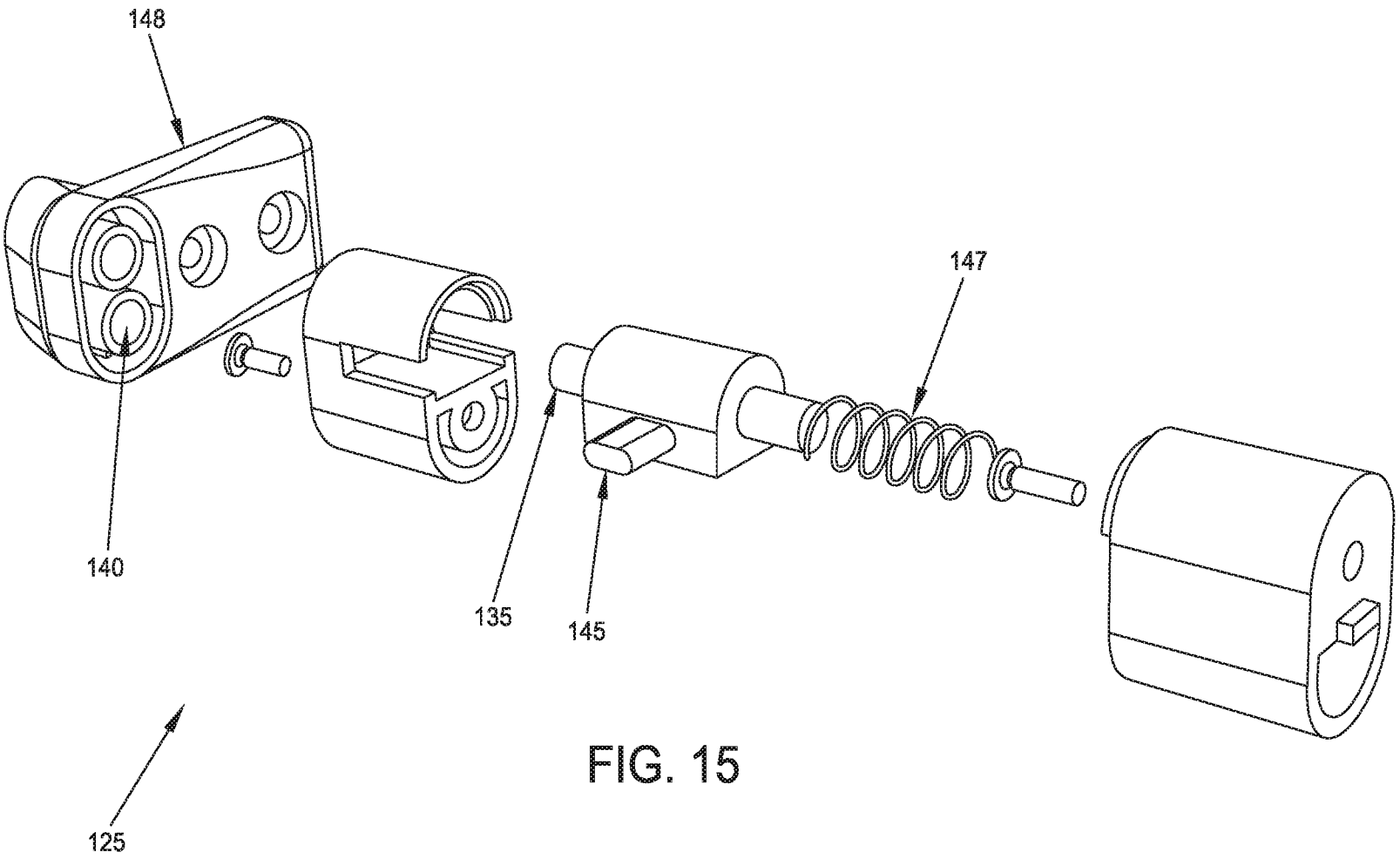

As a result of the foregoing construction, in situations where the objects to be manipulated (e.g., test tubes, beakers, etc.) sit directly on workbase 20 and are relatively short, transparent hinged pane 110 is set in its "up" position (i.e., so that transparent hinged pane 110 covers the upper half of working opening 120 and exposes the lower half of working opening 120, in the manner shown in FIG. 5) so as to provide personnel with appropriate access to the objects which are to be manipulated. However, in situations where the objects to be manipulated sit elevated above workbase 20 (e.g., on a stand or pole) and/or are relatively tall, hinged pane 110 is set in its "down" position (i.e., so that transparent hinged pane 110 covers the lower half of working opening 120 and exposes the upper half of working opening 120, in the manner shown in FIG. 6) so as to provide personnel with appropriate access to the objects which are to be manipulated.

In one preferred form of the invention, hinges 125 are configured so as to be releasable, whereby to allow personnel to remove transparent hinged pane 110 from ductless fumehood 5, e.g., for providing increased access to enclosed workspace 10 (e.g., when introducing or removing apparatus), for servicing or replacement of transparent hinged pane 110, etc. By way of example but not limitation, in one preferred form of the invention, and looking now at FIGS. 11-15, each of the hinges 125 may comprise a spring-biased male finger 135 mounted to transparent hinged pane 110 and a female recess 140 formed in frame 12 of ductless fumehood 5, with a button 145 being provided to allow spring-biased male finger 135 to be moved inboard, whereby to release transparent hinged pane 110 from frame 12. More particularly, in this form of the invention, each of the hinges 125 may comprise a housing 146 which is mounted to transparent hinged pane 110. A spring 147 biases male finger 135 outboard of transparent hinged pane 110, toward female recess 140, such that male finger 135 can extend into female recess 140, whereby to hingedly mount transparent hinged pane 110 to frame 12. Button 145 allows male finger 135 to be forced inboard, against the power of spring 147, whereby to remove male finger 135 from female recess 140, whereby to release transparent hinged pane 110 from frame 12. In one preferred form of the invention, female recess 140 is formed in a housing 148 which is mounted to frame 12.

Figure 16:
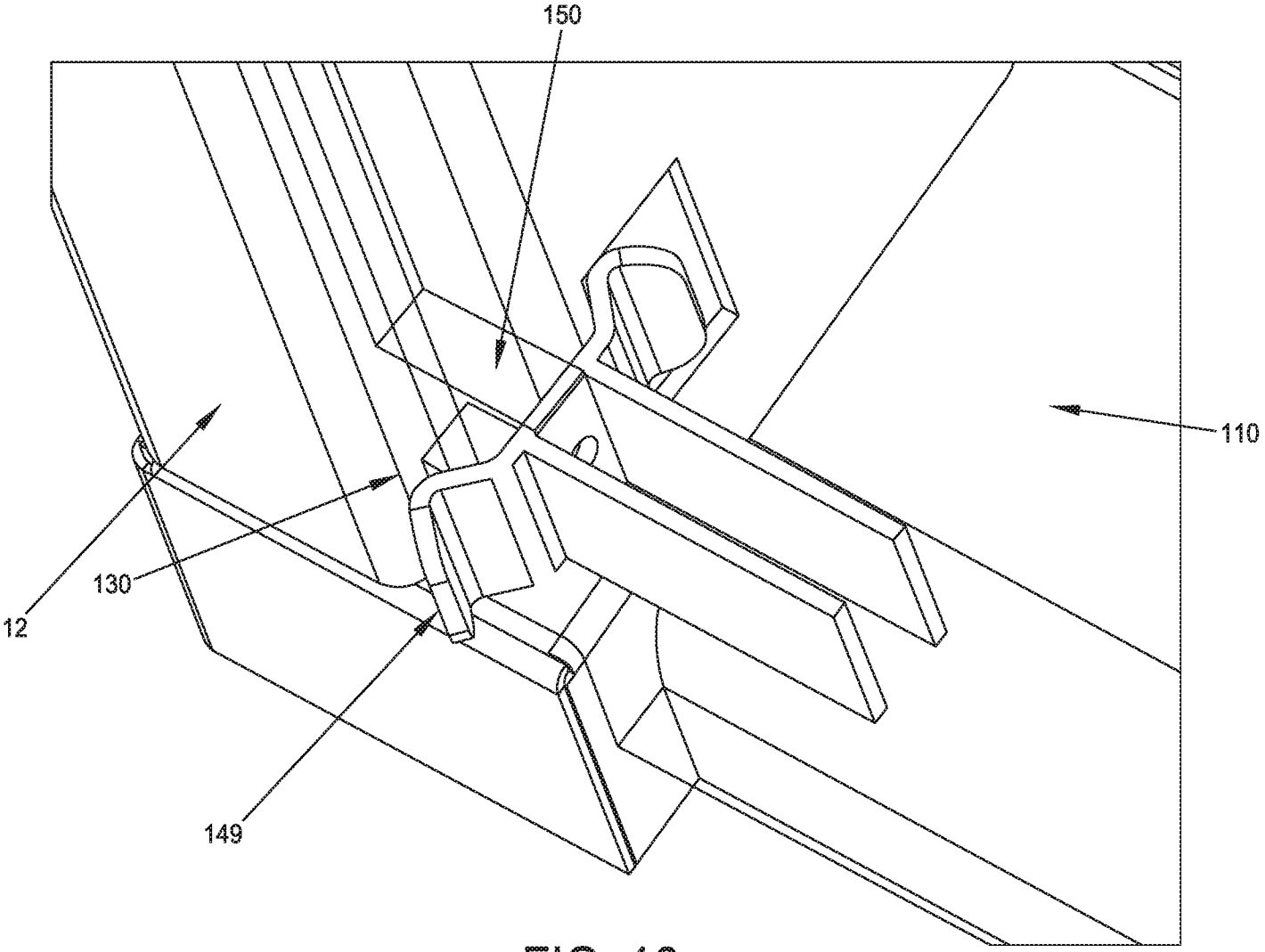
Figure 19:
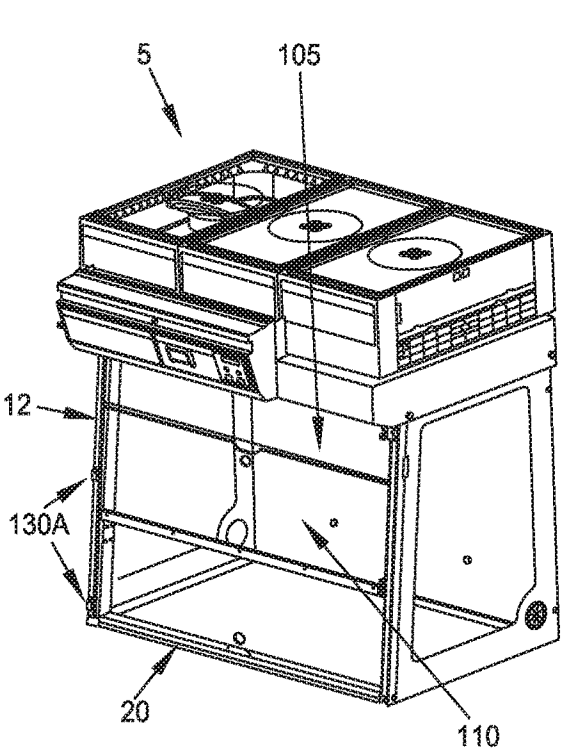
FIGS. 17-19 are schematic views showing another novel ductless fumehood formed in accordance with the present invention.
Figure 18:
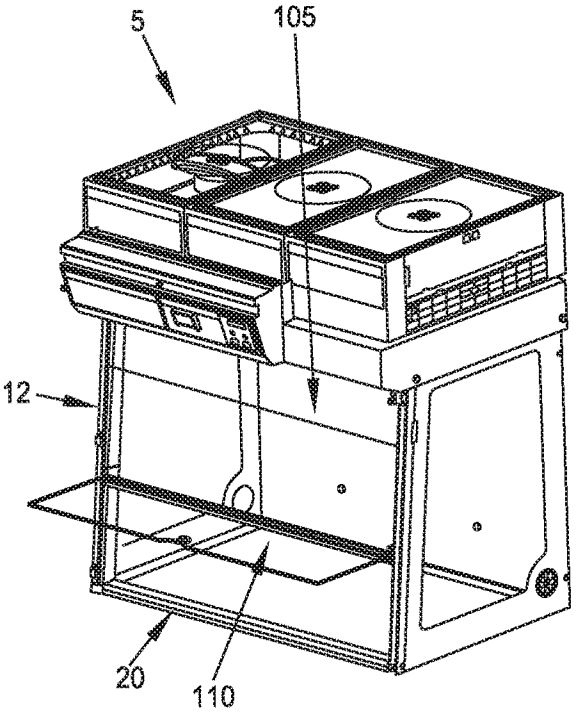
Figure 17:
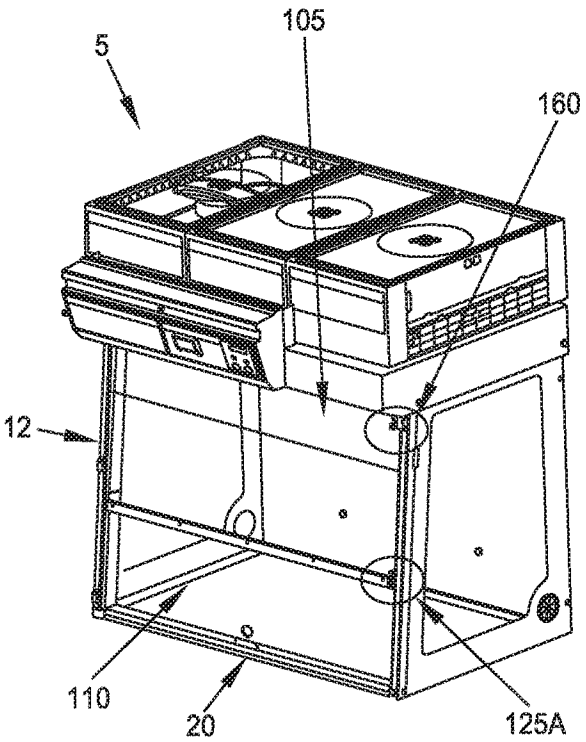
Figure 20:
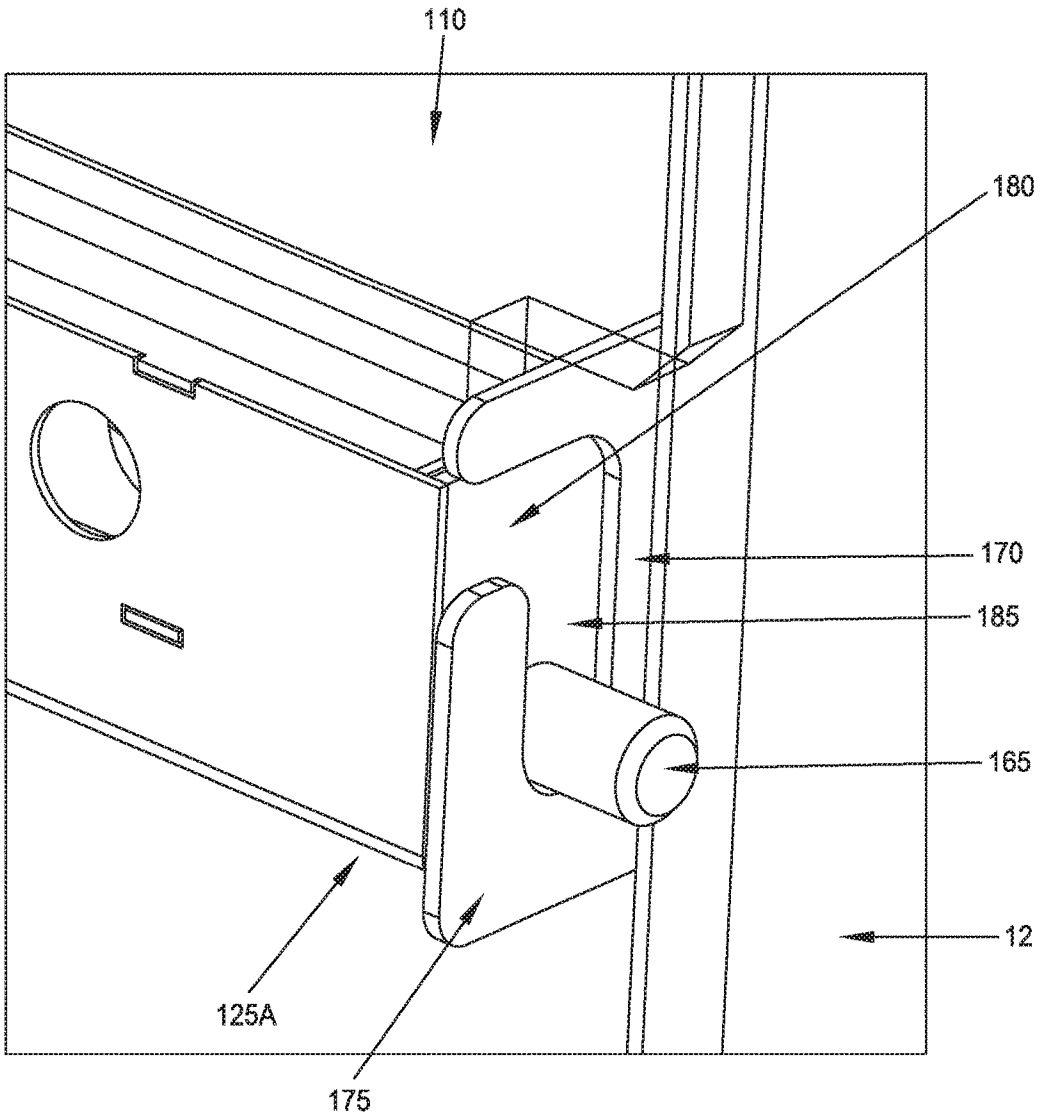
FIGS. 20-24 are schematic views showing various construction details of the novel ductless fumehood shown in FIGS. 17-19.

If desired, and looking now at FIG. 16, latches 130 may comprise a concave member 149 which is slidably mounted to transparent hinged pane 110, and a male projection 150 which projects out of frame 12. In accordance with the present invention, concave member 149 is able to move outboard from transparent hinged pane 110 so as to envelop male projection 150 of frame 12, whereby to latch transparent hinged pane 110 in position on ductless fumehood 5. Correspondingly, concave member 149 is able to move inboard relative to transparent hinged pane 110 so as to separate from male projection 150 of frame 12, whereby to unlatch transparent hinged pane 110 from frame 12.

Figure 22:
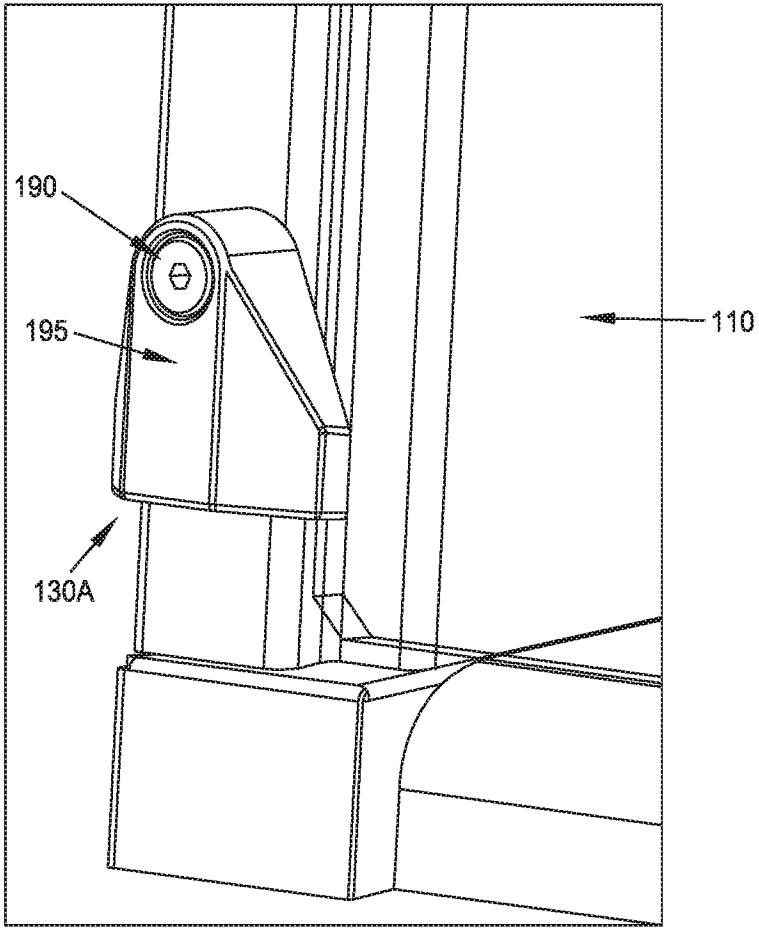
Figure 21:
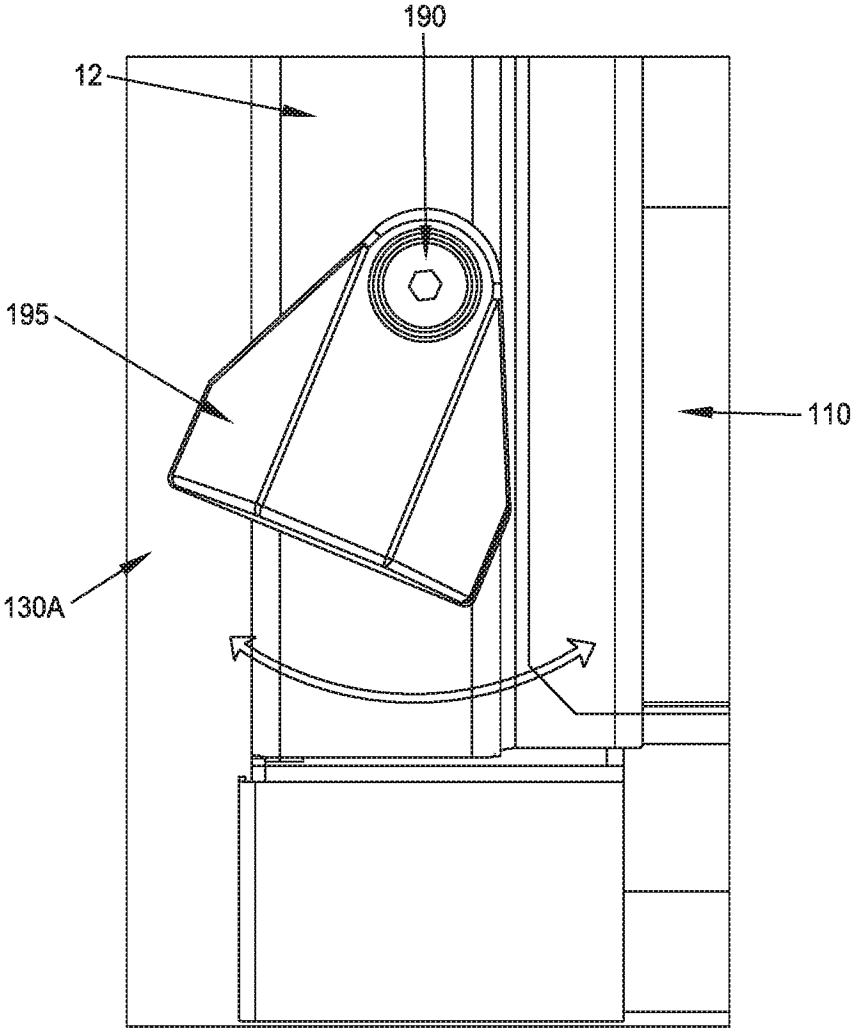
Figure 23:
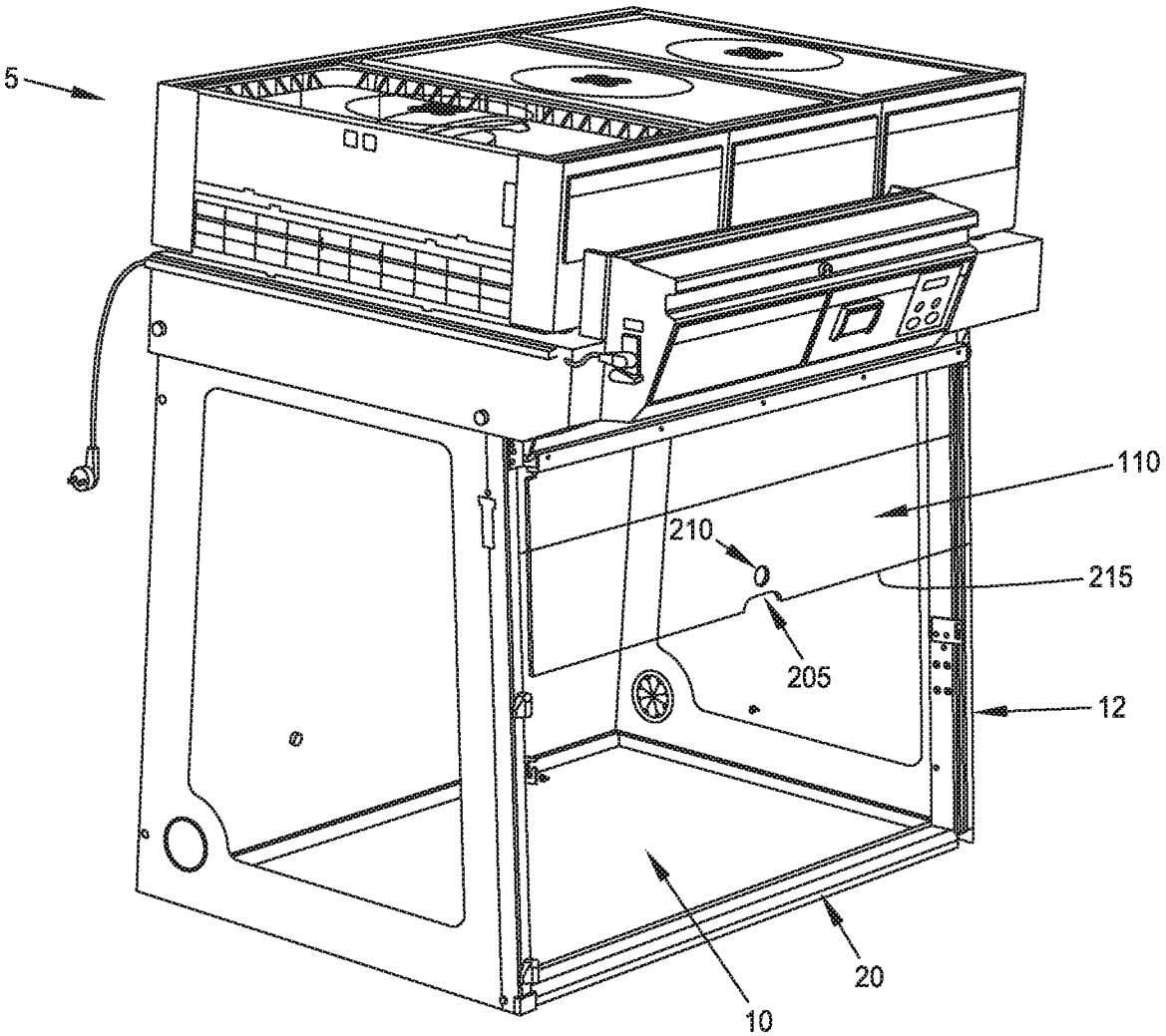
Figure 24:
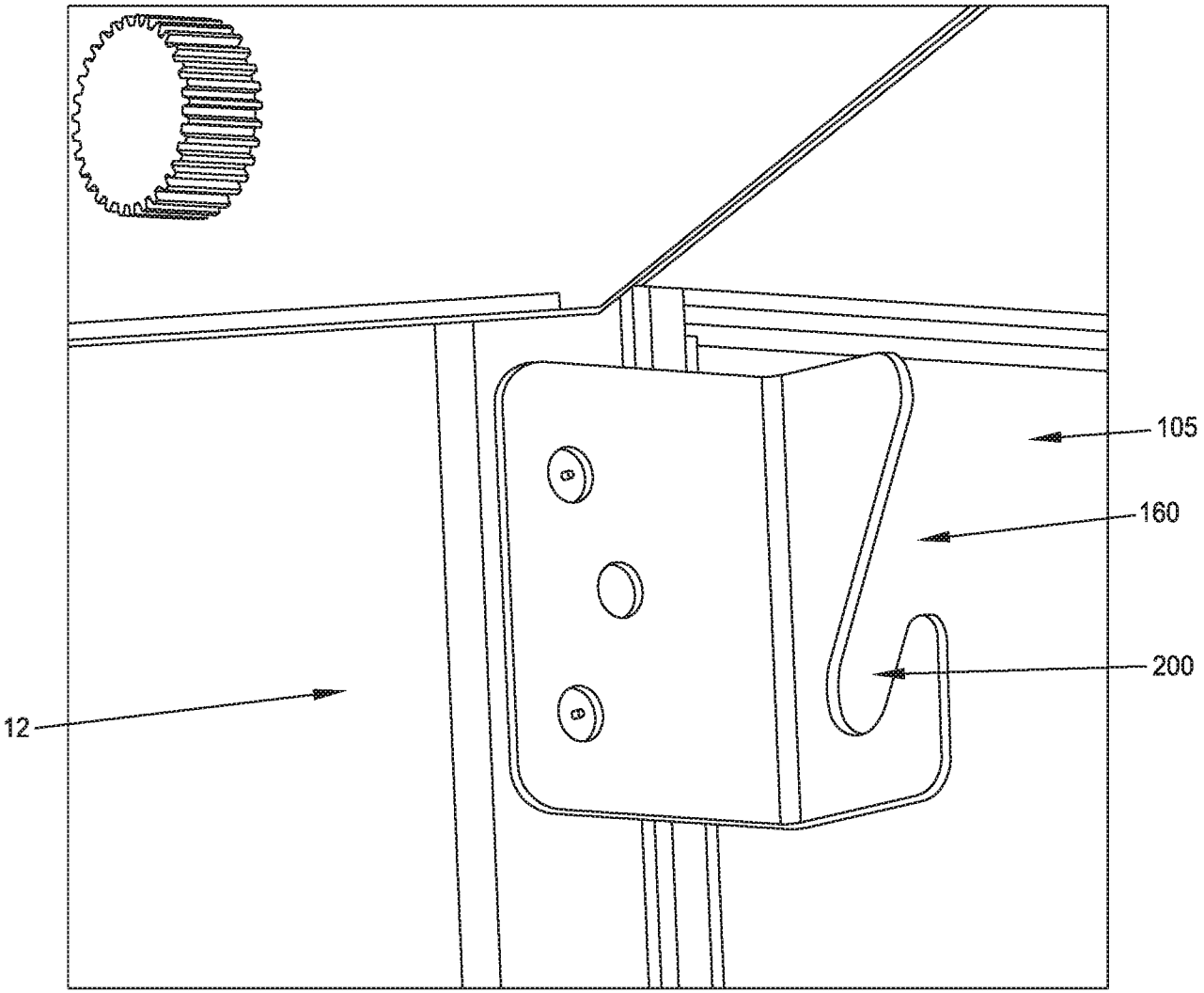

Looking next at FIGS. 17-24, there is shown another preferred form of the present invention. More particularly, in this form of the invention, ductless fumehood 5 comprises alternative hinges 125A (FIGS. 17-20), alternative latches 130A (FIGS. 21 and 22) and a door hang 160 (FIGS. 23 and 24). As seen in FIGS. 17-20, each of the hinges 125A comprises a fixed male finger 165 mounted to transparent hinged pane 110 and an "inverted L"-shaped female recess 170 formed on frame 12 of ductless fumehood 5. In one preferred form of the invention, "inverted L"-shaped female recess 170 is formed by a bracket 175 which is mounted to frame 12, with bracket 175 comprising a horizontal slot 180 and a vertical slot 185. In this embodiment, transparent hinged pane 110 is "hung" on frame 12 by inserting its fixed male finger 165 along horizontal slot 180 of "inverted L"-shaped female recess 170 and then allowing fixed male finger 175 to settle, under the influence of gravity, into the bottom end of vertical slot 185. It will be appreciated that when fixed male finger 175 is disposed at the bottom end of vertical slot 185, transparent hinged pane 110 will be rotatably supported by hinge 125A.

It will also be appreciated that when transparent hinged pane 110 is disposed in its lower position (i.e., the position shown in FIG. 17), gravity holds transparent hinged pane 110 in position and latches 130A (FIGS. 21 and 22) may be used to lock transparent hinged pane 110 in that position. In this respect it will be appreciated that each latch 130A comprises a pivot 190 which rotatably supports a latch body 195 to frame 12, such that latch body 195 can be selectively withdrawn from the path of transparent hinged pane 110 (FIG. 21) or advanced into the path of transparent hinged pane 110 (FIG. 22), whereby to unlatch or latch transparent hinged pane 110, respectively. When transparent hinged pane 110 is to be positioned in its upper position (i.e., the position shown in FIG. 19), latches 130A are unlocked (FIG. 21), transparent hinged pane 110 is swung upward (FIGS. 18 and 19) and then, after transparent hinged pane 110 has been positioned in its upper position (i.e., the position shown in FIG. 19), latches 130A are moved into their locked position (FIG. 22). This action keeps transparent hinged pane 110 from unintentionally falling back into its lower position (i.e., the position shown in FIG. 17).

Note that gravity holds fixed male finger 175 at the bottom end of vertical slot 185 regardless of the position of transparent hinged pane 110.

In some situations it may be desirable to have an enlarged opening with which to access workspace 10 (e.g., when introducing or removing apparatus, etc.). In this situation, transparent hinged pane 110 may be removed from frame 12 by lifting transparent hinged pane 110 upward so that its fixed male finger 165 moves upward along vertical slot 185 and then forward along horizontal slot 180 so that fixed male finger 165 is withdrawn from "inverted L"-shaped female recess 170, whereby to free transparent hinged pane 110 from frame 12. Transparent hinged pane 110 may then be hung on door hangs 160 (FIGS. 23 and 24) by slipping fixed male finger 165 of transparent hinged pane 110 into slots 200 of door hangs 160.

In one preferred form of the present invention, and looking now at FIG. 23, transparent hinged pane 110 may comprise a semi-circular opening 205 and a circular opening 210 adjacent to the edge 215 of transparent hinged pane 110 (i.e., the edge which engages workbase 20). Semi-circular opening 205 and circular opening 210 are sized and positioned so as to accommodate a thumb and finger of personnel, whereby to allow personnel to move transparent hinged pane 110 on its hinges 125A (or 125), whereby to allow transparent hinged pane 110 to be moved between its "up" and "down" positions.

Figure 25:
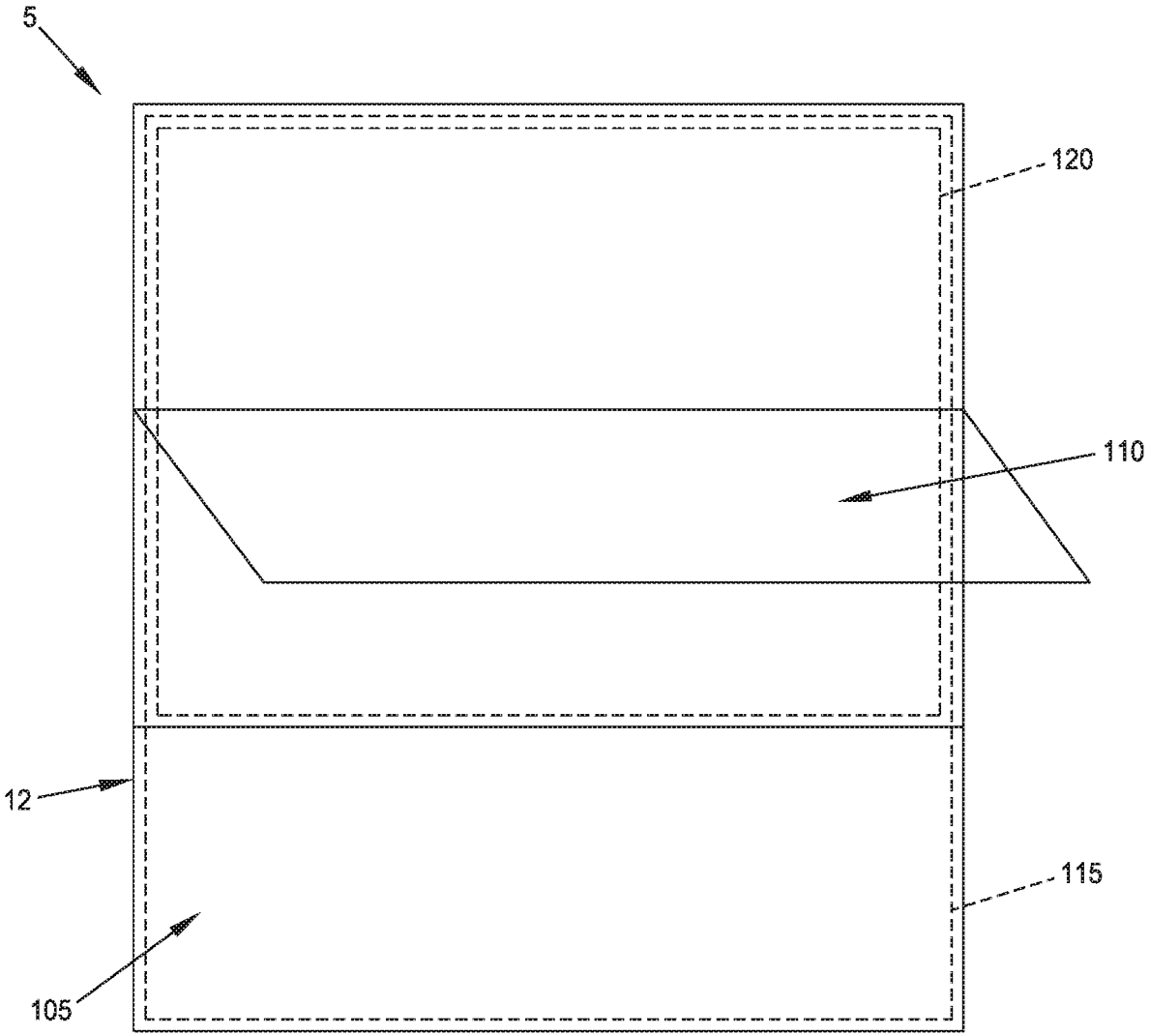
FIG. 25 is a schematic view showing another form of ductless fumehood formed in accordance with the present invention.

In another form of the present invention, and looking now at FIG. 25, transparent fixed pane 105 can be disposed at the bottom end of front opening 115, so that working opening 120 is disposed at the top end of front opening 115. With this configuration, transparent hinged pane 110 is hingedly mounted to frame 12 of ductless fumehood 5 intermediate working opening 120 so as to selectively cover a portion of working opening 120.

Modifications of the Preferred Embodiments

It should be understood that many additional changes in the details, operation, steps and arrangements of elements, which have been herein described and illustrated in order to explain the nature of the present invention, may be made by those skilled in the art while still remaining within the principles and scope of the invention.

What is claimed is:

1. A front sash closure for a fumehood having a workspace defined by a frame and accessed by a front opening, wherein the frame comprises a back portion, a front portion, a top portion, a bottom portion and two side portions connecting the top portion to the bottom portion and the front portion to the back portion, said front sash closure comprising:

a transparent fixed pane securely mounted to the front portion of the frame of the fumehood so as to partially cover the front opening of the fumehood, whereby to reduce the size of the front opening of the fumehood to a working opening, the working opening having a top half and a bottom half, wherein the front portion of the frame surrounding the working opening forms a slanted face, with the slanted face slanting toward the back portion of the frame as the slanted face progresses from the bottom portion of the frame toward the top portion of the frame; and a transparent hinged pane hingedly mounted to the frame of the fumehood, wherein the transparent hinged pane is hingedly mounted to the frame of the fumehood at the midpoint of said working opening so that the transparent hinged pane can be rotated between (i) an up position in which the top half of said working opening is covered by said transparent hinged pane and the bottom half of said working opening is open, and (ii) a down position in which the bottom half of said working opening is covered by said transparent hinged pane and the top half of the said working opening is open, wherein the transparent hinged pane remains in the up position and the down position by gravity.

2. The front sash closure according to claim 1 further comprising two hinges for hingedly mounting said transparent hinged pane to the frame of the fumehood.

3. The front sash closure according to claim 2 wherein said hinges are configured so that said transparent hinged pane is detachable from the frame of the fumehood.

4. The front sash closure according to claim 3 wherein each of said hinges comprises a spring-biased male finger mounted to said transparent hinged pane and a female recess formed in the frame of the fumehood.

5. The front sash closure according to claim 2 wherein each of said hinges comprises a male finger mounted to said transparent hinged pane and an inverted L-shaped female recess formed in the frame of the fumehood.

6. The front sash closure according to claim 5 further comprising two door hangs, wherein each of said door hangs comprises a slot for receiving said male finger.

7. The front sash closure according to claim 1 further comprising at least one latch for preventing movement of said transparent hinged pane relative to the frame of the fumehood.

8. The front sash closure according to claim 7 wherein said at least one latch comprises a concave member slidably mounted to said transparent hinged pane and a male projection which projects out of the frame of the fumehood.

9. The front sash closure according to claim 7 wherein said at least one latch comprises a pivot mounted to the frame which rotatably supports a latch body such that said latch body can be selectively withdrawn from the path of said transparent hinged pane or advanced into the path of said transparent hinged pane.

10. A fumehood, the fumehood comprising:

a workspace defined by a frame and accessed by a front opening, wherein the frame comprises a back portion, a front portion, a top portion, a bottom portion and two side portions connecting the top portion to the bottom portion and the front portion to the back portion; and a front sash closure mounted to said frame, said front sash closure comprising:

a transparent fixed pane securely mounted to the front portion of said frame of said fumehood so as to partially cover said front opening of said fumehood, whereby to reduce the size of said front opening of said fumehood to a working opening, the working opening having a top half and a bottom half, wherein the front portion of the frame surrounding the working opening forms a slanted face, with the slanted face slanting toward the back portion of the frame as the slanted face progresses from the bottom portion of the frame toward the top portion of the frame; and a transparent hinged pane hingedly mounted to said frame of said fumehood, wherein the transparent hinged pane is hingedly mounted to the frame of the fumehood at the midpoint of said working opening so that the transparent hinged pane can be rotated between (i) an up position in which the top half of said working opening is covered by said transparent hinged pane and the bottom half of said working opening is open, and (ii) a down position in which the bottom half of said working opening is covered by said transparent hinged pane and the top half of the said working opening is open, wherein the transparent hinged pane remains in the up position and the down position by gravity.

11. The fumehood according to claim 10 further comprising two hinges for hingedly mounting said transparent hinged pane to said frame of said fumehood.

12. The fumehood according to claim 11 wherein said hinges are configured so that said transparent hinged pane is detachable from said frame of said fumehood.

13. The fumehood according to claim 12 wherein each of said hinges comprises a spring-biased male finger mounted to said transparent hinged pane and a female recess formed in said frame of said fumehood.

14. The fumehood according to claim 11 wherein each of said hinges comprises a male finger mounted to said transparent hinged pane and an inverted L-shaped female recess formed in said frame of said fumehood.

15. The fumehood according to claim 14 further comprising two door hangs, wherein each of said door hangs comprises a slot for receiving said male finger.

16. The fumehood according to claim 10 further comprising at least one latch for preventing movement of said transparent hinged pane relative to said frame of said fumehood.

17. The fumehood according to claim 10 wherein said fumehood is ductless.

18. A method for handling hazardous substances, said method comprising:

providing a fumehood, said fumehood comprising:

a workspace defined by a frame and accessed by a front opening, wherein the frame comprises a back portion, a front portion, a top portion, a bottom portion and two side portions connecting the top portion to the bottom portion and the front portion to the back portion; and a front sash closure mounted to said frame, said front sash closure comprising:

a transparent fixed pane securely mounted to the front portion of said frame of said fumehood so as to partially cover said front opening of said fumehood, whereby to reduce the size of said front opening of said fumehood to a working opening, the working opening having a top half and a bottom half, wherein the front portion of the frame surrounding the working opening forms a slanted face, with the slanted face slanting toward the back portion of the frame as the slanted face progresses from the bottom portion of the frame toward the top portion of the frame; and a transparent hinged pane hingedly mounted to said frame of said fumehood, wherein the transparent hinged pane is hingedly mounted to the frame of the fumehood at the midpoint of said working opening so that the transparent hinged pane can be rotated between (i) an up position in which the top half of said working opening is covered by said transparent hinged pane and the bottom half of said working opening is open, and (ii) a down position in which the bottom half of said working opening is covered by said transparent hinged pane and the top half of the said working opening is open, wherein the transparent hinged pane remains in the up position and the down position by gravity; and positioning the hazardous substances within said workspace of said fumehood.

* * * * *